US005458253A

United States Patent [19]

Shapcott

[11] Patent Number: 5,458,253

[45] Date of Patent: Oct. 17, 1995

[54] BOTTLE CAP

[75] Inventor: Michael Shapcott, Hometown, Pa.

[73] Assignee: ZapatA Technologies, Inc., Hazelton, Pa.

[21] Appl. No.: 115,942

[22] Filed: Sep. 1, 1993

[51] Int. Cl.[6] ..... B65D 41/12

[52] U.S. Cl. ..... 215/328; 215/324; 413/8

[58] Field of Search ..... 215/324, 325, 215/326, 327, 328; 413/8, 11

[56] References Cited

U.S. PATENT DOCUMENTS

| | | | |
|---|---|---|---|
| 468,258 | 2/1892 | Painter . | |
| 856,400 | 6/1907 | Gillette . | |
| 888,995 | 5/1908 | Godman . | |
| 895,066 | 8/1908 | Brewington . | |
| 989,336 | 4/1911 | Coale . | |
| 1,188,263 | 6/1916 | Gaston . | |
| 1,423,105 | 9/1922 | Hansen . | |
| 1,724,213 | 8/1929 | McDonnell . | |
| 1,899,783 | 2/1933 | Warth . | |
| 1,899,784 | 2/1933 | Warth . | |
| 1,900,963 | 3/1933 | Warth . | |
| 1,907,994 | 5/1933 | McManus . | |
| 1,928,987 | 10/1933 | Warth . | |
| 2,048,062 | 7/1936 | Elder . | |
| 2,138,419 | 11/1938 | Gavin | 215/328 X |
| 2,327,454 | 8/1943 | Punte | 215/328 |
| 2,327,455 | 8/1943 | Punte | 215/328 |
| 2,497,870 | 2/1950 | Dennis . | |
| 4,337,871 | 7/1982 | Tucker | 215/328 |
| 4,679,697 | 7/1987 | Allaire | 215/295 |

FOREIGN PATENT DOCUMENTS

| | | |
|---|---|---|
| 1196730 | 11/1959 | France . |
| 2504092 | 10/1982 | France . |
| 68350 | 2/1892 | Germany . |

*Primary Examiner*—Allan N. Shoap
*Assistant Examiner*—Vanessa Caretto
*Attorney, Agent, or Firm*—Pennie & Edmonds

[57] ABSTRACT

A crown seal for sealing an opening of a bottle including a flange having between twenty-eight and thirty-two flutes around the circumference thereof. Each flute comprises depression having a generally triangular surface area between a pair of ridges. The additional flutes provide more points of contact with the bead are provided, ensuring a securement of increased strength between the crown and bottle.

19 Claims, 2 Drawing Sheets

BOTTLE CAP

BACKGROUND OF THE INVENTION

The invention relates to a crown or closure which is preferably used to seal a bottle opening.

Crowns are well known in the art for sealing bottle openings. Such seals are commonly formed of sheet material and comprise a top, a sidewall, and a flared skirt. The skirt includes a plurality of flutes which extend around the circumference thereof at spaced intervals. When applied to cover an open end of a bottle, these flutes bend at the points of intersection between the cap and the skirt, gripping a bead at the upper rim of the opening to seal the bottle.

Typical prior crown designs have incorporated between 21 and 24 flutes, with the current standard crown having 21 flutes. FIG. 1 illustrates a enlarged view of a portion of a standard 21-flute crown design as known in the art. The crown includes a substantially circular top 10 having a downwardly depending skirt 12 and an annular rim or flange 14 extending outwardly from the skirt. The flange 14 is corrugated to provide a plurality of flutes 16. Each flute 16 comprises a substantially trapezoidal-shaped trough or depression 18 defined between a pair of complimentary shaped crests 20.

In this prior design, 21 regions of contact between the trapezoidal depressions 18 and bottle opening are provided when the crown is applied by bending the flange about the bottle opening. To obtain a seal of sufficient strength which will withstand the pressure of carbonated or other beverages typically contained within the bottle, steel is typically used to form the crown. However, the steel is subject to the corrosive effects of the liquid contained within the bottle and also cannot be recycled. Further, the steel edge of the flutes is relatively sharp and can be injurious when grasped by a consumer when the bottle is picked up or opened. This sharp edge can be painful and dangerous when the crown is removed, especially in twist-off bottle designs.

SUMMARY OF THE INVENTION

The present invention provides a crown having between 28 and 32 flutes. The flutes provide a plurality of points of contact when the crown flange is crimped to seal the opening of a bottle, resulting in an increased strength securement of the crown to the bottle. This stronger seal allows the crown to be formed of materials other than steel. In particular, the crown may be formed of aluminum such that the crown will exhibit a high resistance to corrosion from moisture and beverages contained within the bottle. Further, aluminum crowns can be recycled and are less costly to produce. The additional flutes in the crown further provide a smoother grasping surface, causing less discomfort to a user when the crown is removed from the bottle.

In accordance with the invention, a crown seal for sealing an opening of a bottle comprises a top portion and a skirt portion downwardly depending from the roof portion. The skirt portion includes a plurality of substantially V-shaped depressions. A flange extends outwardly from the skirt portion and comprises a plurality of ridges wherein each adjacent pair of ridges defines a depression therebetween which has a substantially triangular surface area. The ridges are generally V-shaped and have an apex at the outer edge of the flange. Each depression has an apex approximately at the inner edge of the flange at the point where the flange intersects the skirt portion of the crown. Preferably, the skirt portion includes between twenty-eight and thirty-two depressions, and the flange includes the same number. The depressions of the skirt member correspond to the depressions of the flange member in the most preferred embodiment.

DETAILED DESCRIPTION OF THE INVENTION

Figure 1:
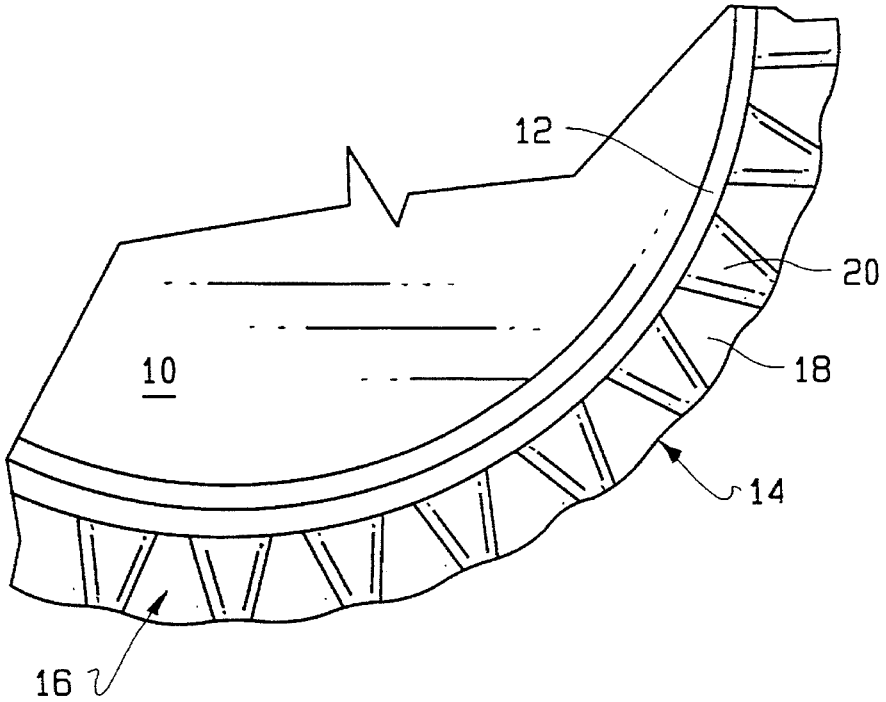
FIG. 1 Prior Art
FIG. 1 is a partial plan view of a prior art crown seal.
Figure 2:
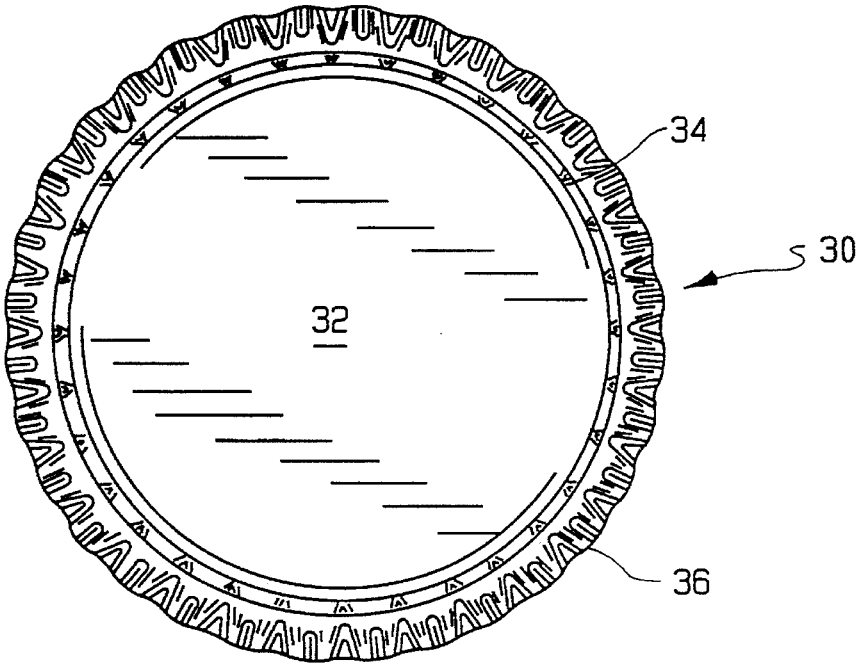
FIG. 2 is a top plan view of a crown seal in accordance with the present invention.
Figure 3:
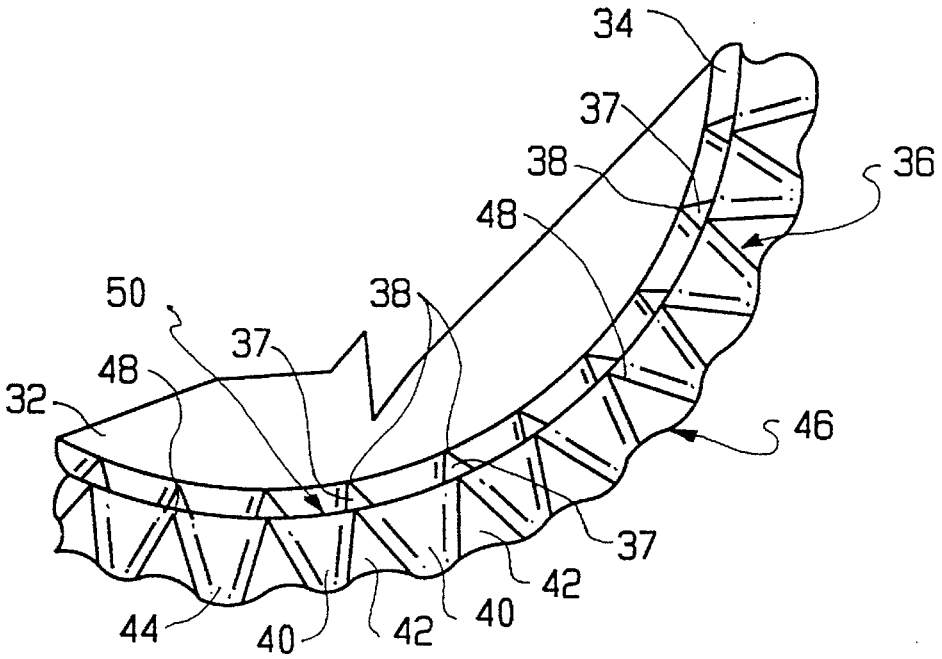
FIG. 3 is an enlarged view of the crown illustrating the shape of the flutes.
Figure 4:
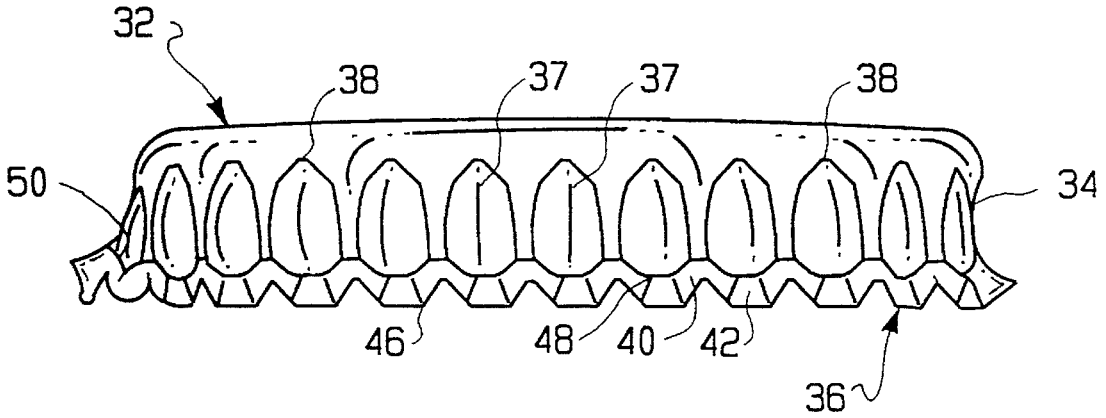
FIG. 4 is a side view of the crown.

FIGS. 2–4 illustrate a crown seal 30 in accordance with the present invention. The crown 30 includes a substantially circular top 32, a downwardly depending skirt 34 and an annular flange 36 extending outwardly from the skirt. As best illustrated in FIGS. 3 and 4, the skirt 34 includes a series of depressions 37 around the exterior surface thereof. The depressions 37 are generally V-shaped having an apex 38 near the top 32 of the crown.

Referring again to FIGS. 3 and 4, the flange 36 is fluted to provide a plurality of ridges 40 around the circumference thereof. The ridges 40 are substantially V-shaped, having an apex 44 at an outer edge 46 of the flange 36. Each pair of ridges 40 defines a depression 42 therebetween having a substantially triangular surface area, wherein an apex 48 of the triangular area is approximately at an inner edge 50 of the flange 36, at its intersection with the skirt 34. The depressions 37 and 42 of the present invention are smaller in surface area and narrower in width than in previous designs, allowing more flutes to be formed around the circumference of the skirt 34 and flange 36. Between twenty-eight and thirty-two flutes are formed in the skirt 34 and flange 36, with a preferred number of flutes formed in the skirt and flange having been found to be thirty-two.

As discussed above, when the crown 30 is applied to cover the opening of a bottle (not shown), the flange 36 portion is flattened such that the ridges 40 extend downwardly and the triangular depressions 42 formed in the flange are forced underneath the bead which encircles the opening in the bottle. With the narrower flute design of the present invention, more points of contact with the bead are provided, ensuring a securement of increased strength between the crown 30 and bottle. The increased number of flutes also provides a smoother grasping surface which causes less discomfort when the crown is removed from the bottle by a consumer.

This increased seal strength enables the crown 30 to be formed from materials other than the steel which has been traditionally used. Preferably, the crown closure of the present invention is formed of a tempered aluminum, such as alloy 3444 which has the following characteristics:

| | |
|---|---|
| Approximate thickness | .0095 + .001 inches |
| Temper range | H-19 to H-22 |
| Ultimate Load | 146 lbs. |
| Yield Load | 130 lbs. |
| Ultimate strength | 31.9 lbs. |
| Yield strength | 28.8 lbs. |

There are many advantages to aluminum as the crown material. When formed of aluminum, the crown 30 exhibits high corrosion resistance to liquids which may be contained in the bottle such as juice, carbonated soda, or beer. In addition, the aluminum crowns may be recycled for further use. As aluminum is more ductile than the steel material typically used, crown seals in accordance with the invention are more easily removed from the bottle than in prior designs. In addition, aluminum is less expensive than steel, and thus the crowns can be produced at a lower cost.

The increased number of flutes further provides less friction when the cap is removed. The following tests of the amount of torque required to remove both twist-off and pry-off cap types illustrate that crowns with 28 and 32 corrugations of flutes require less torque for removal than those having 21 or 24 corrugations. Data was collected for five samples of each cap type at various times after the cap was applied to the bottle. The maximum and minimum values obtained for each cap type are presented below.

| VARIABLE-# OF CORRUGATIONS ON CAP | 90° F. AFTER REPASTEURIZATION | ONE WEEK AT 40° F. | ONE WEEK AT ROOM TEMPERATURE | AVERAGE OF 3 READINGS |
|---|---|---|---|---|
| | TORQUE - INCH POUNDS (Twist Cap) | | | |
| 21 (Min. value)/(Max. value) | 7.7/8.6 | 7.1/8.9 | 7.8/9.1 | 7.6/8.8 |
| 24 (Min. value)/(Max. value) | 7.5/7.8 | 6.7/7.8 | 6.7/7.5 | 7.0/7.7 |
| 28 (Min. value)/(Max. value) | 7.3/7.7 | 6.5/7.5 | 6.9/7.3 | 6.9/7.5 |
| 32 (Min. value)/(Max. value) | 7.6/7.7 | 6.4/6.7 | 7.0/7.2 | 7.0/7.2 |
| | TORQUE - INCH POUNDS (Pry-Off Cap) | | | |
| 21 (Min. value)/(Max. value) | 9.3/10.7 | 8.5/11.8 | 10.7/11.8 | 9.5/11.4 |
| 24 (Min. value)/(Max. value) | 8.7/9.7 | 7.1/8.3 | 7.6/8.3 | 7.8/8.8 |
| 28 (Min. value)/(Max. value) | 7.3/9.3 | 7.2/7.8 | 9.2/9.7 | 7.9/8.9 |
| 32 (Min. value)/(Max. value) | 7.7/8.2 | 7.8 | 8.1 | 7.9/8.0 |

Additional tests conducted on twist-off crowns having 32 flutes further demonstrate the reduced torque levels required to remove crowns constructed in accordance with the present invention:

| TORQUE (INCH POUNDS) - 32 FLUTE CROWNS | MINIMUM | MAXIMUM | AVERAGE |
|---|---|---|---|
| INITIAL | 5.6 | 7.4 | 6.4 |
| AFTER PASTEURIZATION | 5.7 | 8.0 | 6.4 |

-continued

| TORQUE (INCH POUNDS) - 32 FLUTE CROWNS | MINIMUM | MAXIMUM | AVERAGE |
|---|---|---|---|
| 1 DAY AT ROOM TEMP. | 5.8 | 8.4 | 7.0 |
| 1 DAY AT 40° F. | 6.6 | 8.9 | 7.8 |
| | TEST AVERAGE | | 6.9 |

With the increased number of flutes, less force is required to apply the cap to the bottle. The results of crowning force tests conducted for both twist-off and pry-off caps are presented below.

| VARIABLE - # OF CORRUGATIONS ON CAP | AVERAGE POUNDS |
|---|---|
| CROWNING FORCE (Twist Cap) | |
| 21 | 466 |
| 24 | 432 |
| 28 | 417 |
| 32 | 396 |
| CROWNING FORCE (Pry-Off Cap) | |
| 21 | 567 |
| 24 | 535 |
| 28 | 516 |
| 32 | 480 |

As can be readily seen from the results of the above tests, significantly less crowning force is required to secure caps with 32 or 28 flutes than is required for caps with 21 or 24 flutes. This decrease in required crowning force produces less stress on crowning machinery.

In the crown formation process, a sheet of aluminum is punched, i.e., cut, into a disc of predetermined size. The disc is then shaped to the desired configuration by a form punch which pushes the disc into a form die having serrations cut in the desired shape and number of the flutes. Accordingly, in order to produce the crown described above, the disc is pressed into a form die having between twenty-eight and thirty-two generally triangular serrations formed therein. The finished crowns are then applied to bottles in accordance with conventional crowning techniques.

As will be apparent to those skilled in the art, various modifications and adaptations of the embodiments described above will become readily apparent without departure from the spirit and scope of the invention, the scope of which is defined in the appended claims.

What is claimed is:

1. A crown for sealing a bottle opening comprising:

a circular top portion having a fluted skirt extending around the circumference thereof, said skirt comprising a plurality of substantially invented V-shaped depressions wherein the apex of each V-shaped depression is adjacent said top portion, and a fluted, annular flange extending radially outwardly from said skirt, said flange comprising a plurality of ridges, with each adjacent pair of said ridges defining a depression therebetween having a substantially triangular surface area.

2. The crown defined in claim 1, wherein said flange comprises between twenty-eight and thirty-two depressions.

3. The crown of claim 2 wherein said skirt comprises between twenty-eight and thirty-two depressions.

4. The crown defined in claim 3, wherein said flange has an inner edge adjacent to said top portion and an outer edge forming the periphery of the crown, and said ridges are generally V-shaped having an apex near said outer edge of said flange.

5. The crown of claim 4 wherein said depressions of said skirt each have an apex that extends toward said circular top.

6. The crown defined in claim 1, wherein said crown is formed of aluminum.

7. The crown of claim 1 wherein an average crowning force of about 417 pounds or less for a twist cap or about 516 pounds or less for a pry-off cap is required to apply the crown to a bottle.

8. A closure for sealing a bottle opening comprising:

a top portion;

a skirt portion downwardly depending from said top portion and comprising a plurality of substantially inverted V-shaped depressions wherein the apex of each V-shaped depression is adjacent said top portion; and a flange which extends radially outwardly from said skirt portion, said flange comprising a plurality of ridges, with each adjacent pair of said ridges defining a depression therebetween having a substantially triangular surface area.

9. The closure defined in claim 8, wherein said adjacent ridges are generally V-shaped having an apex at an outer edge of said flange.

10. The closure defined in claim 8, wherein each depression has an apex approximately at an inner edge of said flange where said flange intersects said skirt portion of said closure.

11. The closure defined in claim 8, wherein said flange includes twenty-eight to thirty-two depressions.

12. The closure of claim 11 wherein said skirt includes twenty-eight to thirty-two depressions which correspond to the depressions of the flange portion.

13. The closure defined in claim 8, wherein said closure is formed of tempered aluminum.

14. The closure of claim 8 wherein a average crowning force of about 417 pounds or less for a twist cap or about 516 pounds or less for a pry-off cap is required to apply the closure to a bottle.

15. A method of forming a crown comprising a circular top portion having a fluted side portion around the circumference thereof which comprises forming a skirt and a radially outwardly extending flange portion in said side portion; forming a plurality of inverted V-shaped depressions in said skirt portion, wherein the apex of each V-shaped depression is adjacent said top portion, and forming a plurality of ridges in said flange portion, such that each adjacent pair of said ridges defines a depression therebetween having a substantially triangular surface area.

16. The method of claim 15 wherein between twenty-eight and thirty-two depressions are formed in the flange portion.

17. The method of claim 16 wherein between about twenty-eight and thirty-two depressions are formed in the skirt portion corresponding to the depressions of the flange portion.

18. The method of claim 15 wherein the crown is formed of aluminum.

19. The method of claim 15 wherein a average crowning force of about 417 pounds or less for a twist cap or about 516 pounds or less for a pry-off cap is required to apply the crown to a bottle.

* * * * *